United States Patent [19]

Snelling

[11] 4,136,637

[45] Jan. 30, 1979

[54] CONTINUOUS CONTRAST DEVELOPMENT SYSTEM

[75] Inventor: Christopher Snelling, Penfield, N.Y.

[73] Assignee: Xerox Corporation, Stamford, Conn.

[21] Appl. No.: 776,015

[22] Filed: Mar. 9, 1977

[51] Int. Cl.[2] ..... G03G 15/09

[52] U.S. Cl. ..... 118/658

[58] Field of Search ..... 118/657, 658, 651, 656, 118/661, 258; 355/3 DD

[56] References Cited

U.S. PATENT DOCUMENTS

| | | | |
|---|---|---|---|
| 149,706 | 4/1874 | Baldwin | 118/258 |
| 3,064,622 | 11/1962 | Thompson | 118/657 X |
| 3,081,737 | 3/1963 | Frantz et al. | 118/657 X |
| 3,133,834 | 5/1964 | Sowiak | 118/657 |
| 3,245,381 | 4/1966 | Brennisen et al. | 118/661 |
| 3,362,380 | 1/1968 | Anderson et al. | 118/657 X |
| 3,472,676 | 10/1969 | Cassiers et al. | 118/661 X |
| 3,500,793 | 3/1970 | Bartusek | 118/661 |
| 3,635,195 | 1/1972 | Levy | 118/661 X |
| 3,830,199 | 8/1974 | Saito et al. | 118/661 |
| 3,839,992 | 10/1974 | Takahashi | 118/657 X |
| 3,881,927 | 5/1975 | Fantuzzo | 355/3 DD X |
| 3,941,084 | 3/1976 | Kuritu | 118/657 X |
| 3,974,554 | 8/1976 | Fantuzzo | 118/661 |
| 3,993,024 | 11/1976 | Stansell | 118/661 |
| 4,018,187 | 4/1977 | Abbott et al. | 118/658 |
| 4,024,838 | 5/1977 | Horie | 118/661 |

*Primary Examiner*—Werner H. Schroeder
*Assistant Examiner*—Andrew M. Falik
*Attorney, Agent, or Firm*—J. J. Ralabate; C. A. Green; H. Fleischer

[57] ABSTRACT

A development apparatus in which the donor member has a pattern of depressed regions therein. The donor member moves developer material into contact with a sheet of support material disposed adjacent an electrostatic latent image recorded on a photoconductive surface. Inasmuch as the donor member has a pattern of depressed regions therein, the developer material is deposited on the sheet of support material in a half-tone pattern.

6 Claims, 3 Drawing Figures

CONTINUOUS CONTRAST DEVELOPMENT SYSTEM

The foregoing abstract is neither intended to define the invention disclosed in the specification nor is it intended to be limiting as to the scope of the invention in any way.

BACKGROUND OF THE INVENTION

This invention relates generally to an electrophotographic printing machine, and more particularly concerns a development apparatus employing a single component magnetic developer material.

In the process of electrostatographic printing, an electrostatic latent image is formed on a surface and reproduced in viewable form. The broad class of electrostatographic printing includes electrophotography and electrography. Electrophotography employes a photosensitive medium to form, with the aid of electromagnetic radiation, an electrostatic latent image on the photosensitive medium. Electrography is that class of electrostatography which utilizes an insulating means to form, without the aid of electromagnetic radiation, the electrostatic latent image. Hereinafter, an electrophotographic printing process will be discussed wherein the single component magnetic developer material is deposited directly onto the sheet of support material by the development apparatus. In electrophotography, a photosensitive element having a photoconductive insulating layer is charged to a substantially uniform potential in order to sensitize its surface. The charged photoconductive surface is exposed to a light image of an original document being reproduced. As a consequence of the exposure, the charge is selectively dissipated in the irradiated areas in accordance with the intensity of light reaching the surface thereof. This forms an electrostatic latent image on the photoconductive surface corresponding to the informational areas contained within the original document. The electrostatic latent image recorded on the photoconductive surface may then be developed by bringing a developer material into contact therewith. Alternatively, a sheet of support material may be placed in contact with the latent image recorded on the photoconductive surface and the developer material brought into contact with the sheet of support material. In this latter embodiment, the developer material is attracted directly to the copy sheet. Contrawise, in the former embodiment, the developer material must be transferred from the photosensitive member to the copy sheet. In both of the foregoing processes, developer material is heated to permanently affix it to the copy sheet. The broad concept of electrophotographic printing was originally disclosed by Carlson in U.S. Pat. No. 2,297,691 and is further amplified and described by many related patents in the art. Exemplary patents describing machines wherein the copy sheet is positioned on the photoconductive member prior to development are the following: U.S. Pat. No. 2,885,955 issued to Vyverberg in 1959, U.S. Pat. No. 3,093,039 issued to Rheinfrank in 1963, U.S. Pat. No. 3,166,432 issued to Gundlach in 1965, and U.S. Pat. No. 3,251,706 issued to Walkup in 1966.

In the foregoing types of printing machines, a development apparatus is employed to deposit developer material onto either the copy sheet or the photoconductive member. Generally, the developer material comprises toner particles, which are mixed with coarser carrier granules. Typical toner particles are made from a thermoplastic material while the carrier granules are made from a ferromagnetic material. Alternatively, single component magnetic particles may be employed.

A system utilizing single component magnetic developer would be capable of high speeds. One type of development apparatus employing a single component magnetic material is described in U.S. Pat. No. 2,846,333 issued to Wilson in 1958. It has been found that when a single component magnetic developer material is employed, the resultant copy has high contrast. However, continuous tone graduations are difficult to obtain. The development process is dependent upon the spacing between the donor roll and photoconductive surface. Thus, changes in the spacing between the photoconductive surface and donor roll or copy sheet and donor roll will effect the resultant contrast. Various types of donor rolls have been developed which have irregular surfaces. For example, U.S. Pat. No. 3,246,629 issued to Shelfo discloses a flame spray used to provide a layer of irregular shaped particles which adhere to the exterior circumferential surface of the developer roll providing a randomly roughened surface. U.S. Pat. No. 3,863,603 issued to Buckley et al. describes a magnetic brush roller having a resilient roughened polyurethane coating thereon. Similarly, U.S. Pat. No. 3,176,652 issued to Mott describes a magnetic brush apparatus having an elongated magnet held stationarily in a rotating shield. The shield may be plastic with the outer surface thereof roughened in a random or rectangular pattern. Finally, U.S. Pat. No. 3,563,734 issued to Shely discloses a developer powder applicator made from an roller coated with a conductive rubber or hardened conductive gelatin. The roller may be a rotatably mounted non-magnetic metal cylinder containing a stationary permanent magnet therein.

However, none of the prior art patents appear to disclose a donor member having a screen pattern thereon in order to vary the spacing between the photoconductive member and donor member so as to form a continuous gray scale during the development process.

Accordingly, it is a primary object of the primary invention to improve the donor roll used in the development apparatus employed of an electrostatographic printing machine.

SUMMARY OF THE INVENTION

Briefly stated, and in accordance with the present invention, there is provided a development apparatus arranged to be used in an electrophotographic printing machine.

Pursuant to the features of the invention, the development apparatus includes a housing defining a chamber for storing a supply of developer material therein. A donor member is disposed in the chamber of the housing for advancing the developer material into the development zone. The donor member has a pattern of depressed regions thereon.

BRIEF DESCRIPTION OF THE DRAWINGS

Other objects and advantages of the present invention will become apparent upon reading the following detailed description and upon reference to the drawings, in which.

While the present invention will be described in conjunction with a preferred embodiment thereof, it will be understood that it is not intended to limit the invention to that embodiment. On the contrary, it is intended to cover all alternatives, modifications, and equivalents as may be included within the spirit and scope of the invention.

DETAILED DESCRIPTION OF THE INVENTION

Figure 1:
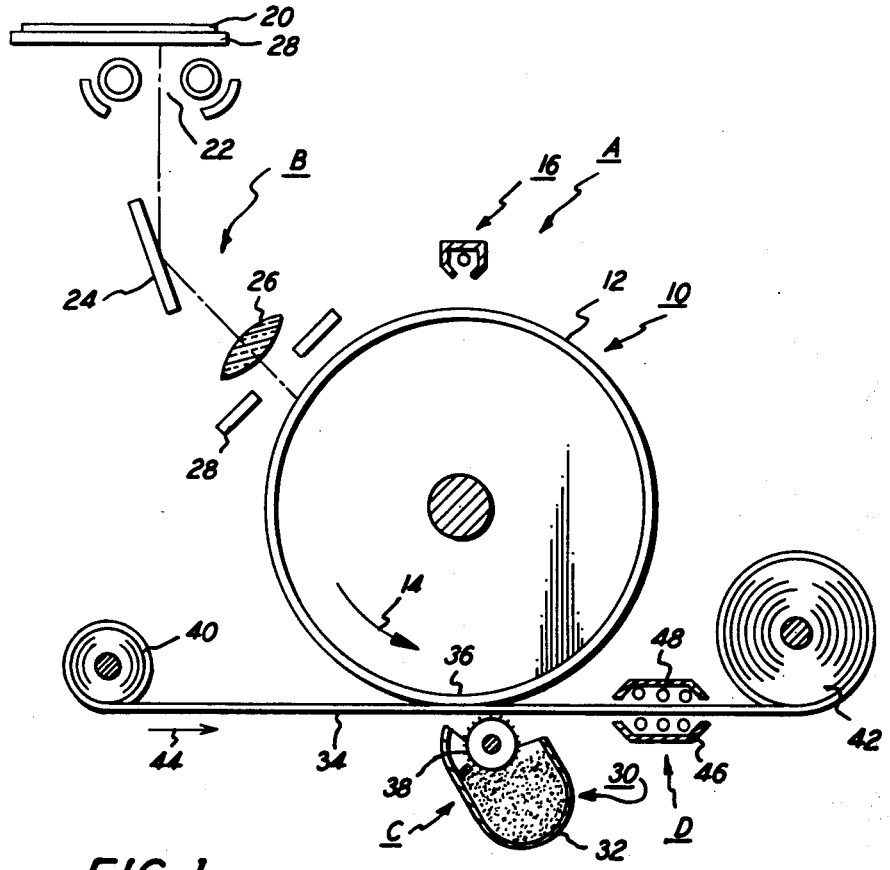
FIG. 1 is a schematic elevational view depicting an electrophotographic printing machine incorporating the features of the present invention therein.

For a general understanding of an electrophotographic printing machine incorporating the features of the present invention therein, reference is had to FIG. 1 which depicts schematically the various components thereof. In the drawings, like reference numerals have beem employed throughout to designate identical elements. Although the development system of the present invention is particularly well adapted for use in the FIG. 1 electrophotographic printing machine, it will become evident from the following discussion that it is equally well suited for use in a wide variety of electrostatographic printing machines and is not necessarily limited in its application to the particular embodiment shown herein. For example, the FIG. 1 electrophotographic printing machine employs a copy sheet positioned directly onto the photoconductive member with the developer material being deposited directly thereon. Alternatively, the electrophotographic printing machine may employ a transfer process. In such a machine, the development apparatus deposits the developer material onto the photoconductive member and the toner particles are transferred therefrom to the copy sheet. Thus, the development apparatus hereinafter described may be employed in either of the foregoing types of printing machines or any of a wide variety of electrostatographic printing machines.

Inasmuch as the pratice of electrophotographic printing is well known in the art, the various processing stations for reproducing an original document are represented in FIG. 1 schematically.

An electrophotographic printing machine employs a drum 10 having a photoconductive surface 12 entrained about and secured to the exterior circumferential surface of a conductive substrate. Drum 10 is rotated in the direction of arrow 14 so that a portion of photoconductive surface 12 passes through the various processing stations disposed about its periphery. By way of example, photoconductive surface 12 may be a selenium alloy of the type described in U.S. Pat. No. 2,970,906 issued to Bixby in 1961, while the conductive substrate may be made from aluminum.

Initially, drum 10 rotates a portion of photoconductive surface 12 through charging station A. Charging station A includes a corona generating device, indicated generally by the reference numeral 16. Corona generating device 16 is located closely adjacent to photoconductive surface 12. When energized, corona generating device 16 charges a portion of photoconductive surface 12 to a substantially high relatively uniform potential. One type of suitable corona generating device is described in U.S. Pat. No. 2,836,725 issued to Vyverberg in 1958.

The charged portion of photoconductive surface 12 is next rotated to exposure station B. Exposure station B includes a transparent platen 18 for supporting an original document 20 thereon. Original document 20 may be a single sheet or book, amongst others. Lamps 22 illuminate original document 20. The light rays transmitted from original document 20 are reflected by mirror 24 through lens 26. Scanning of original document 20 is achieved by moving lamps 22 and lens 26 in a timed relationship with the rotation of drum 10. In this way, a flowing light image of the original document is formed. The light image transmitted through lens 26 passes through the slit of aperture plate 28 onto the charged portion of photoconductive surface 12. Irradiation of the charged portion of photoconductive surface 12 selectively dissipates the charge thereon recording an electrostatic latent image corresponding to original document 20.

Next, the electrostatic latent image recorded on photoconductive surface 12 is rotated to development station C. At development station C, a developer unit 30 having a housing 32 defining a chamber for storing a supply of single component magnetic material therein forms a powder image on support material 34. Support material 34 may be a web of plain paper, a cut sheet of plain paper, a web of thermoplastic material, or a sheet of thermoplastic material, amongst others. Developer unit 32 is a magnetic brush development system. In a system of this type, the single component magnetic developer material is brought through a directional flux field forming a brush thereof. The brush of magnetic developer material contacts support material 34 in development zone 36. In development zone 36, support material 34 contacts photoconductive surface 12, in superimposed registration with the electrostatic latent image recorded thereon. The electrostatic latent image attracts electrostatically the single component magnetic developer material from donor roll 38 to form a powder image on support material 34. The detailed structural configuration of donor roll 38 will be described hereinafter with reference to FIGS. 2 and 3. Donor roll 38 is arranged to advance the single component magnetic material from the lower regions of the chamber in housing 32 to the development zone 36. In this way, support material 34 contacts the brush of developer material and the electrostatic latent image recorded on photoconductive surface 12 attracts it thereto forming a toner powder image thereon.

Support material 34 passes from a feed roll 40 to a takeup roll 42. As a drive motor (not shown) rotates takeup roll 42, support material 34 advances into development zone 36 between photoconductive surface 12 and donor roll 38. As shown in FIG. 1, support material 34 moves in the direction of arrow 44 so as to be interposed between photoconductive surface 12 and donor roll 38 in development zone 36. As the support material 34 passes through development zone 36, a powder image corresponding to the original document is deposited thereon. Thereafter, support material 34 continues to advance in the direction of arrow 44 so as to pass through fixing station D.

At fixing station D, fusing device 46 applies sufficient heat to permanently affix the toner powder image to support material 34 in image configuration. Fusing device 46 may utilize heating elements 48 for applying heat to melt and fix the powder image to support material 34. Preferably, heating elements 48 comprise a high electrical resistance wire wound helically about a quartz rod. This type of fusing device is described in U.S. Pat. No. 2,965,868 issued to Eichler in 1960. The copy may then be cut to size and removed from the printing machine.

It is believed that the foregoing description is sufficient for the purposes of the present application to illustrate the general operation of an electrophotographic printing machine embodying the features of the present invention therein. Referring now to the specific subject matter of the present invention, FIGS. 2 and 3 depict in detail, the structure of the donor roll 38 employed in development apparatus 30.

Figure 2:
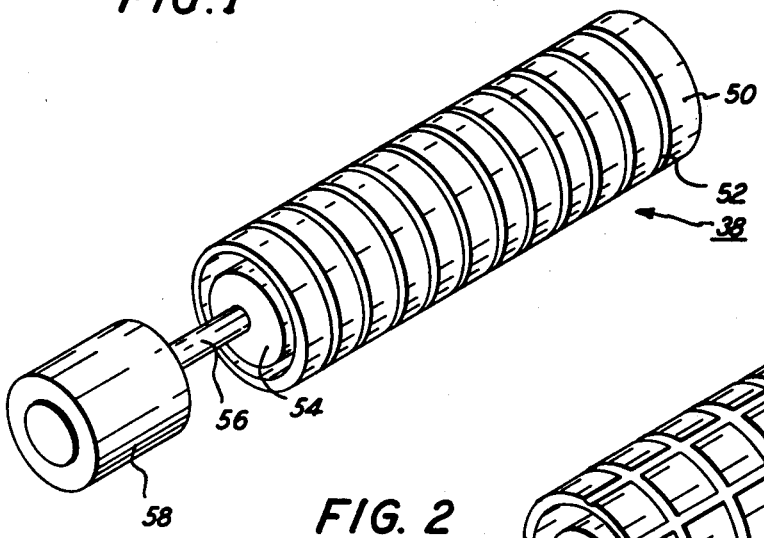
FIG. 2 is a schematic perspective view illustrating one embodiment of the donor roll employed in the development apparatus of the FIG. 1 printing machine.

Referring now to FIG. 2, there is shown one embodiment of donor roll 38. As depicted therein, donor roll 38 includes a non-magnetic tubular member 50. Preferably, tubular member 50 is made from aluminum. Tubular member 50 includes a plurality of depressed regions 52 therein. Depressed regions 52 are a plurality of grooves extending about the circumferential surface of tubular member 50. Grooves 52 are substantially equally spaced from one another in a direction extending along the longitudinal axis of tubular member 50. Tubular member 50 is interfit telescopically over magnetic member 54. Preferably magnetic member 54 is made of barium ferrite in the form of a cylindrical member having poles impressed about the circumferential surface thereof. A shaft 56 made preferably of steel is concentrically mounted within tubular member 50 and serves as a support for magnetic member 54. Motor 58 is coupled to shaft 56 and rotates magnet 54 relative to tubular member 50. Tubular member 50 remains substantially stationary. In this way, the developer material is advanced from the lower regions of the chamber of housing 32 (FIG. 1) to development zone 36 (FIG. 1) as magnetic member 54 rotates relative to tubular member 50. Grooves 52 in tubular member 50 are oriented so as to be substantially parallel to the direction of rotation of drum 10, as indicated by arrow 14. These grooves vary the spacing between tubular member 50 and photoconductive surface 12 so as to introduce tone gradations in the copy being reproduced. A power supply (not shown) applies an electrical bias to donor roll 38. The voltage applied thereto may be about 500 volts. However, the voltage level is adjustable and depends upon the background voltage level of photoconductive surface 12.

Figure 3:
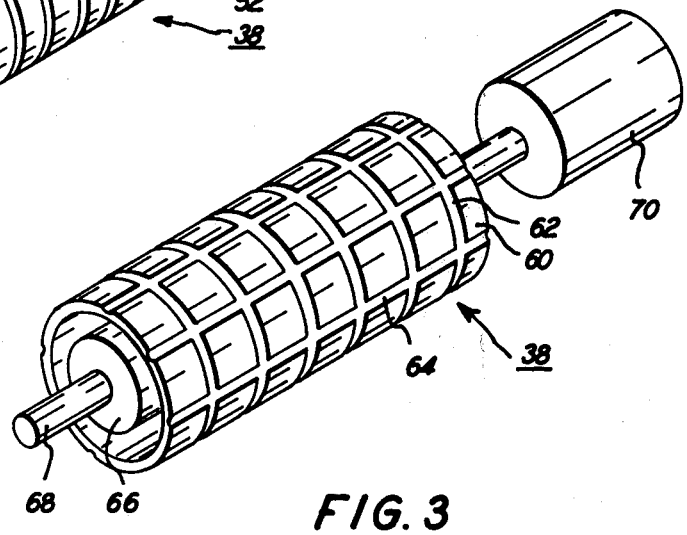
FIG. 3 is a schematic perspective view showing another embodiment of a donor roll used in the development apparatus of the FIG. 2 printing machine.

Referring now to FIG. 3, still another embodiment of donor roll 38 is shown therein. As depicted in FIG. 3, tubular member 60 includes a pair of sets of plurality of grooves. One set of a plurality of grooves 62 is substantially normal to the other set of plurality of grooves 64. Grooves 62 extend about the circumferential surface of tubular member 60 being substantially equally spaced from one another in a direction along the longitudinal axis of tubular member 60. The other set of grooves 64 extend substantially parallel to the longitudinal axis of tubular member 60. These grooves are equally spaced from one another about the circumferential surface of tubular member 60. Grooves 62 are substantially normal to grooves 64. Tubular member 60 is interfit telescopically over magnetic member 66. Shaft 68 is mounted concentrically within tubular member 60 and serves as a fixed mounting for magnetic member 66. Preferably, tubular member 16 is a non-magnetic material, such as aluminum. Shaft 68 is made preferably from steel. Magnetic member 66 is an elgonated cylinder member pressed onto shaft 68 being made preferably from barium ferrite having poles impressed about tge circumferential surface thereof. In this embodiment, motor 70 rotates tubular member 60 relative to magnetic member 66. Thus, magnetic member 66 remains substantially stationary while tubular member 60 rotates relative thereto so as to advance the developer material from the lower regions of housing 32 (FIG. 1) to development zone 36 (FIG. 1). In this manner, grooves in tubular member 60 vary the spacing between donor roll 38 and photoconductive surface 12 so as to produce tone graduations in the resultant copy. As hereinbefore indicated, a powder supply (not shown) may electrically bias donor roll 38.

In recapitulation, the development apparatus includes a donor member having a plurality of depressed regions therein. In one embodiment, i.e., where the magnetic member rotates relative to the tubular member, a one dimensional array of grooves is formed in the tubular member. Alternatively, in another embodiment, wherein the tubular member rotates relative to the magentic member, a two dimensional array of grooves is formed in the tubular member. In both of the foregoing embodiments, the grooves formed in the tubular member of the donor member act as a screen to produce tone graduations in the copy.

It is, therefore, evident that there has been provided in accordance with this invention, an apparatus for developing an electrostatic latent image that fully satisfies the objects, aims and advantages hereinbefore set forth. While this invention has been described in conjunction with specific embodiments thereof, it is evident that many alternatives, modifications and variations will be apparent to those skilled in the art. Accordingly, it is intended to embrace all such alternatives, modifications and variations that fall within the spirit and broad scope of the appended claims.

What is claimed is:

1. A development apparatus, including:

a housing defining a chamber for storing a supply of developer material therein; and a donor member disposed in the chamber of said housing for advancing the developer material into the development zone, said donor member comprising a magnetic member, and a tubular member interfit telescopically over said magnetic member, said tubular member having at least two sets of plurality of grooves, one set of said plurality of grooves extending about the circumferential surface of said tubular member and being substantially equally spaced from one another in a direction extending along the longitudinal axis of said tubular member and the other set of said plurality of grooves extending substantially parallel to the longitudinal axis of said tubular member and being substantially equally spaced from one another about the circumferential surface of said tubular member.

2. An apparatus as recited in claim 1, further including means for rotating said magnetic member relative to said tubular member with said tubular member being substantially stationary.

3. A development apparatus, including:

a housing defining a chamber for storing a supply of developer material therein;

a donor member disposed in the chamber of said housing for advancing the developer material into the development zone, said donor member comprising a magnetic member and a tubular member interfit telescopically over said magnetic member, said tubular member having at least two sets of plurality of grooves, one set of said plurality of grooves extending about the circumferential surface of said tubular member and being substantially equally spaced from one another in a direction extending along the longitudinal axis of said tubular member and the other set of said plurality of grooves extending substantially parallel to the longitudinal axis of said tubular member and being substantially equally spaced from one another about the circumferential surface of said tubular member, and means for rotating said tubular member relative to said magnetic member with said magnetic member being substantially stationary.

4. An electrostatographic printing machine for reproducing an original document on a sheet of support material, wherein the improved development apparatus includes:

a housing defining a chamber for storing a supply of developer material therein; and a donor member disposed in the chamber of said housing for advancing the developer material into the development zone, said donor member comprising a magnetic member, and a tubular member interfit telescopically over said magnetic member, said tubular member having at least two sets of plurality of grooves, one set of said plurality of grooves extending about the circumferential surface of said tubular member and being substantially equally spaced from one another in a direction extending along the longitudinal axis of said tubular member, and the other set of said plurality of grooves extending substantially parallel to the longitudinal axis of said tubular member and being substantially equally spaced from one another about the circumferential surface of said tubular member.

5. A printing machine as recited in claim 4, further including means for rotating said magnetic member relative to said tubular member with said tubular member being substantially stationary.

6. An electrostatographic printing machine for reproducing an original document on a sheet of support material, wherein the improved development apparatus includes:

a housing defining a chamber for storing a supply of developer material therein;

a donor member disposed in the chamber of said housing for advancing the developer material into the development zone, said donor member comprising a magnetic member and a tubular member interfit telescopically over said magnetic member, said tubular member having at least two sets of plurality of grooves, one set of said plurality of grooves extending about the circumferential surface of said tubular member and being substantially equally spaced from one another in a direction extending along the longitudinal axis of said tubular member, and the other set of said plurality of grooves extending substantially parallel to the longitudinal axis of said tubular member and being substantially equally spaced from one another about the circumferential surface of said tubular member; and means for rotating said tubular member relative to said magnetic member with said magnetic member being substantially stationary.

* * * * *